United States Patent [19]

Perry et al.

[11] Patent Number: 5,041,295

[45] Date of Patent: Aug. 20, 1991

[54] PACKAGE FOR CRISPING THE SURFACE OF FOOD PRODUCTS IN A MICROWAVE OVEN

[75] Inventors: Michael R. Perry, Plymouth; Dennis A. Lonergan, Corcoran; Belinda K. Ash, Golden Valley; Anthony B. Taylor, Minneapolis, all of Minn.

[73] Assignee: The Pillsbury Company, Minneapolis, Minn.

[21] Appl. No.: 70,293

[22] Filed: Jul. 6, 1987

[51] Int. Cl.[5] ..... B56D 81/34; H05B 6/64

[52] U.S. Cl. ..... 426/107; 426/113; 426/126; 426/127; 426/234; 426/243; 219/10.55 E

[58] Field of Search ..... 426/107, 234, 243, 113, 426/126, 127, 124; 219/10.55 E, 10.55 M

[56] References Cited

U.S. PATENT DOCUMENTS

| | | | |
|---|---|---|---|
| 3,615,713 | 10/1971 | Stevenson | 99/171 H |
| 3,941,967 | 3/1976 | Sumi et al. | 219/10.55 |
| 4,190,757 | 2/1980 | Turpin et al. | 426/107 |
| 4,210,674 | 7/1980 | Mitchell | 426/107 |
| 4,230,924 | 10/1980 | Brastad et al. | 426/107 |
| 4,258,086 | 3/1981 | Beall | 426/243 |
| 4,267,420 | 5/1981 | Brastad | 426/107 |
| 4,268,738 | 5/1981 | Flautt, Jr. | 219/10.55 |
| 4,283,427 | 8/1981 | Winters et al. | 426/107 |
| 4,455,333 | 6/1984 | Hong et al. | 426/94 |
| 4,640,838 | 2/1987 | Isakson et al. | 426/107 |
| 4,641,005 | 2/1987 | Seiferth | 219/10.55 |
| 4,703,148 | 10/1987 | Mikulski et al. | 219/10.55 |
| 4,720,410 | 1/1988 | Lundquist | 426/107 |
| 4,777,053 | 10/1988 | Tobelmann et al. | 426/107 |
| 4,786,513 | 11/1988 | Monforton et al. | 426/107 |
| 4,835,352 | 5/1989 | Sasaki et al. | 219/10.55 E |

*Primary Examiner*—Wilbur Bascomb

*Attorney, Agent, or Firm*—Arnold, White & Durkee

[57] ABSTRACT

A method and apparatus for crisping the surface of a food substance in a microwave oven is disclosed. A thin film susceptor is positioned close to the surface of a food substance. The susceptor heats when it is exposed to microwave radiation. The susceptor preferably is a thin film of metal deposited on a polyester substrate layer. In one embodiment, heating the susceptor causes the polyester layer to shrink, thereby simultaneously creating openings in the susceptor to allow moisture to escape, and breaking the conductivity of the susceptor so that it becomes less responsive to microwave radiation and substantially "turns off." In an alternative embodiment, passageways are pre-cut in the thin film of metal. A single surface of the food substance is made crisp in this manner, while the opposed surface is exposed to the microwave oven atmosphere. It has been discovered that a consumer will perceive a food product as crisp if a single surface is made crisp in the manner according to the present invention, and the opposed surface is not soggy or mushy.

60 Claims, 5 Drawing Sheets

FIG.1
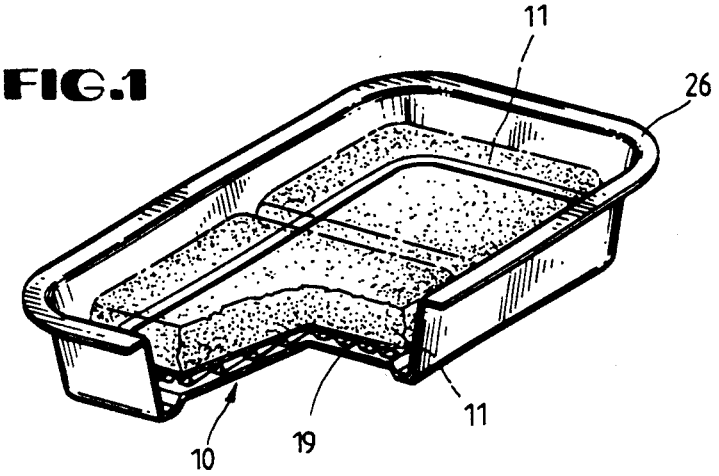
FIG.13
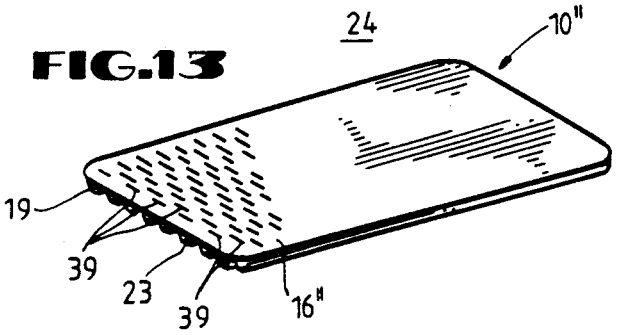
FIG.13A
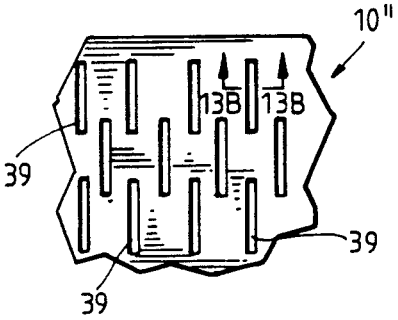
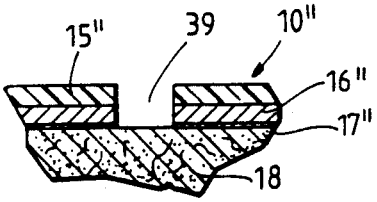
FIG.13B
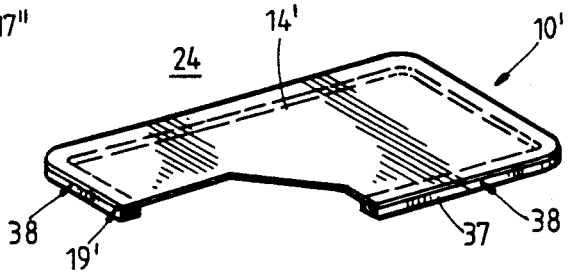
FIG.12

FIG.2
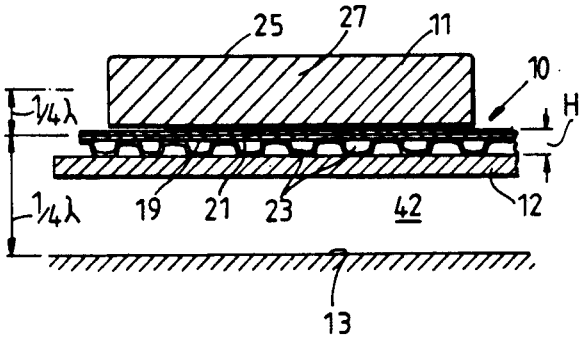
FIG.3
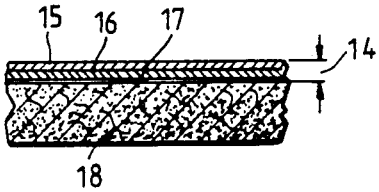
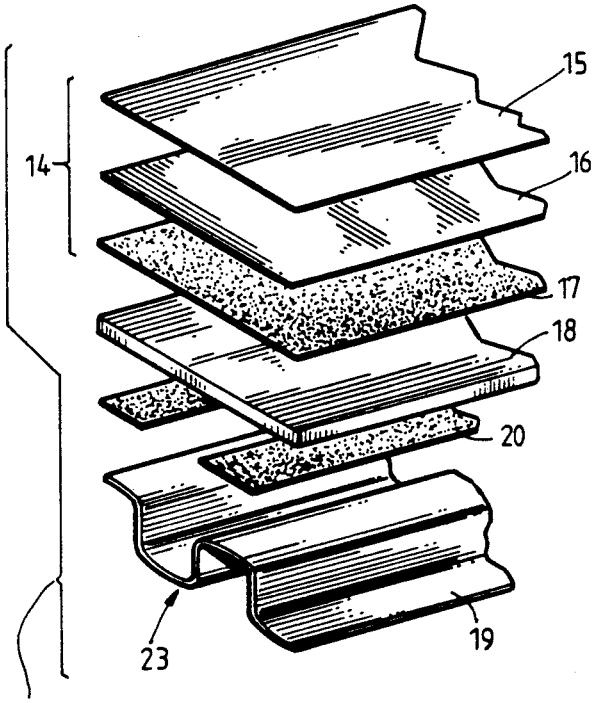
FIG.4
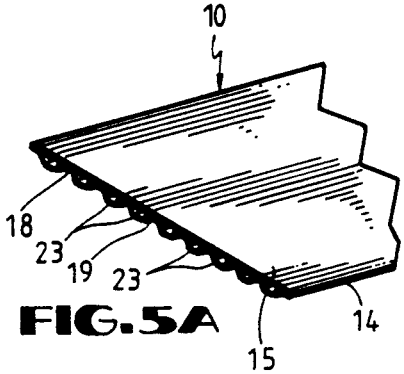
FIG.5A
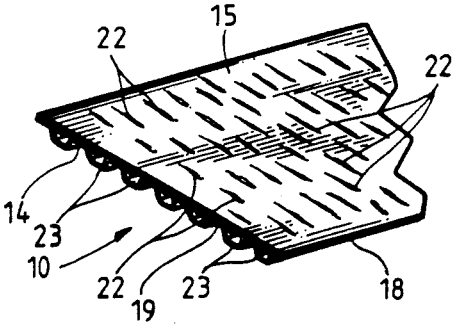
FIG.5B
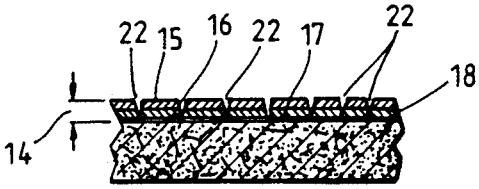
FIG.6

FIG.7A
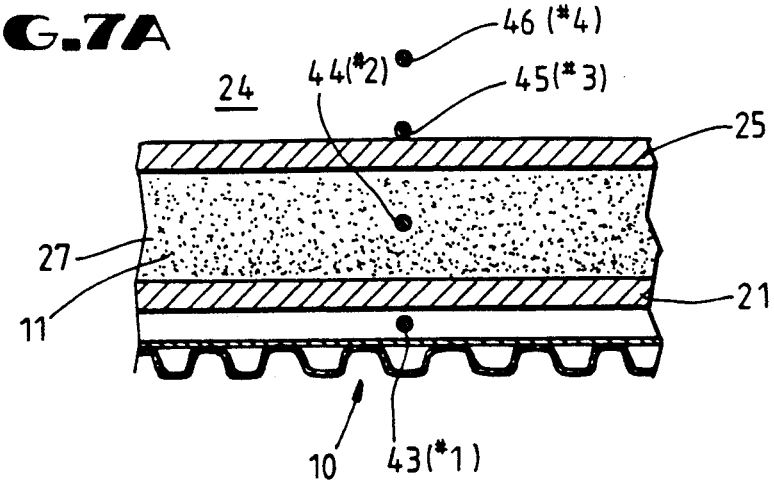
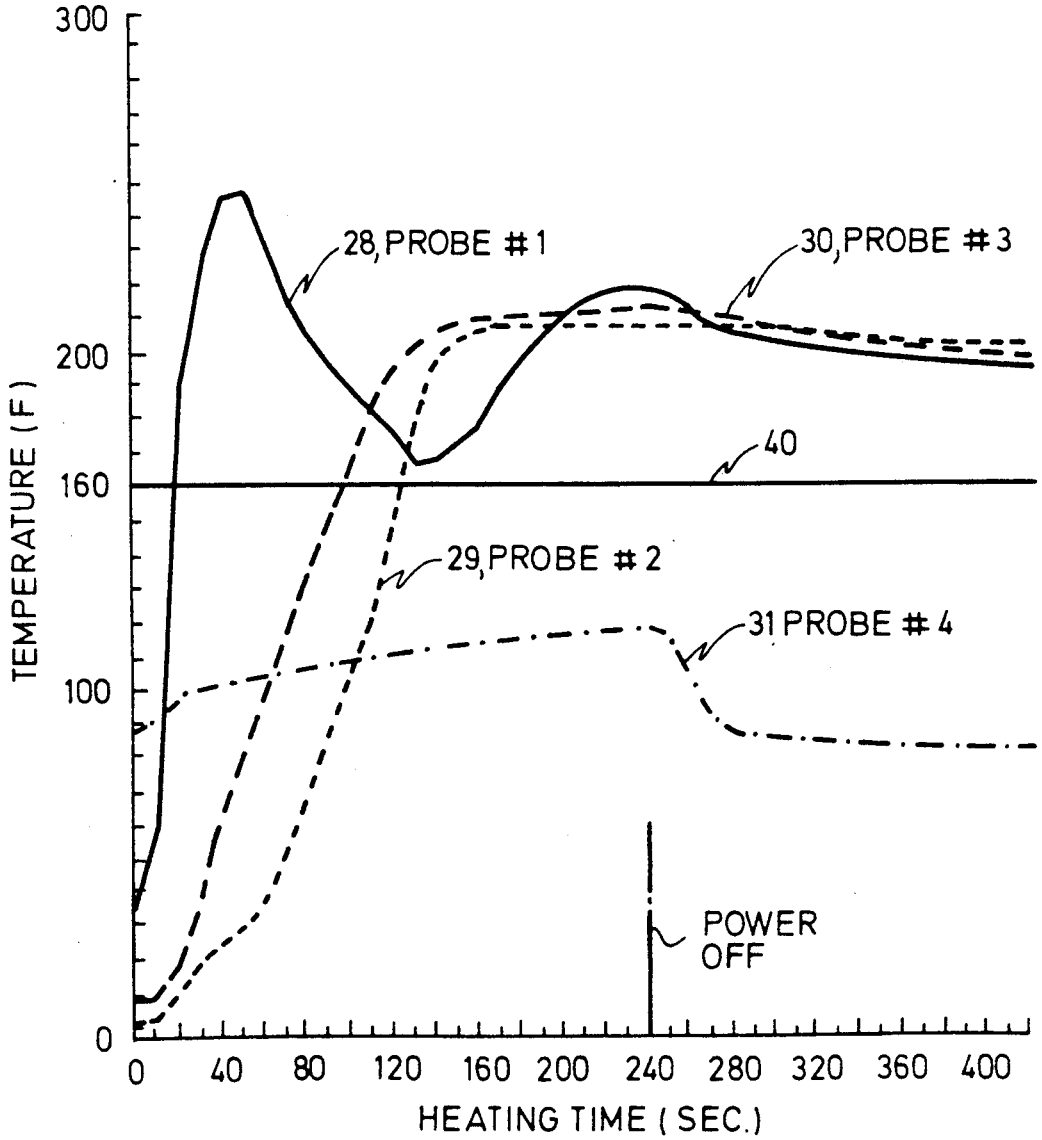
FIG.7

CRISPNESS SCORE
MOISTURE CONTENT (PERCENT)
36
41
42'
60
50
40
30
22
20
10
0
6
7
8
9
10
11
12
13
14
15
16

TEMPERATURE (DEGREES °F)
HEATING TIME (SEC.)
POWER OFF
32
33
34
35
40
300
200
160
100
0
0
40
80
120
160
200
240
280
320
360
400

PACKAGE FOR CRISPING THE SURFACE OF FOOD PRODUCTS IN A MICROWAVE OVEN

FIELD OF THE INVENTION

The present invention involves a packaging system for microwave cooking which is especially useful in crisping a breaded and battered exterior surface of a high moisture content food substance, such as fish.

BACKGROUND OF THE DISCLOSURE

Microwave ovens often provide a quick and convenient way of cooking and heating food substances. Microwave ovens typically heat food substances more quickly than a conventional oven. In some instances, for example, a product which must be cooked for 30 minutes in a conventional oven may be cooked in a microwave oven in 4 minutes or less.

However, microwave energy cooks foods differently from a conventional oven. In a conventional oven, the high temperature atmosphere impinges on the surface of the food substance, causing the surface to heat first. Moisture is driven from the exterior surface of the food substance by the hot oven atmosphere, and this often results in a crisp exterior surface of the food substance. Initially a temperature gradient is established where the center of the food substance is cool, and the exterior surface is elevated in temperature by the heat of the oven. The movement of moisture is affected by the nature of the temperature gradient. Other heat transfer mechanisms may also be at work, e.g., radiation from a heat source. But such mechanisms result in heating that initially starts at the surface and progresses relatively slowly toward the center of the food substance. Transfer of heat to the center of the food substance is by conduction and possibly other heat transfer mechanisms. Moisture migration in a conventional oven environment is normally conducive to achieving a crisp exterior surface.

A microwave oven, on the other hand, generates high intensity, high frequency electromagnetic radiation which penetrates into a food substance. Heating occurs when the electromagnetic energy is absorbed by the food substance. Different food substances, and different layers of the same food item, may absorb different amounts of microwave energy. The amount of heating depends upon the strength of the electric field as it penetrates a particular layer of the food, and the tendency of that layer to absorb microwave energy. In most cases, the heating effects of microwave energy penetrate to a much greater depth toward the center of the food substance than is the case with a conventional oven. The center of a food substance will be heated much more quickly. In sharp contrast to the situation which may exist in a conventional oven, where the surface of the food substance is heated to a high temperature, in a microwave oven a breaded and battered surface is rarely heated sufficiently to crisp it.

Although the surface of a battered and breaded food product may be in a high intensity field, the tendency of that layer to absorb microwave energy is too low to cause it to be elevated to a sufficiently high temperature to result in a crisp surface. To make matters worse, moisture is typically driven from the interior of a high moisture content food substance, such as fish, when the interior of the food substance is rapidly heated by microwave energy. The surface, if it is not heated sufficiently to drive this moisture away, will end up with too much moisture to achieve desirable crispness.

In any event, it will be appreciated that the heat gradient set up in a microwave oven will often differ dramatically from that of a conventional oven. These differences dramatically affect the taste and substance of some foods to the point where microwave cooking of such foods has resulted in unacceptable food quality.

In the past, uneven heating of food substances in microwave ovens may have been observed. However, there has been little or no appreciation for why such uneven heating occurs in microwave ovens. There have been general efforts to avoid uneven heating by rotating food substances in the microwave oven during irradiation. And even if there has been some appreciation of some of the mechanisms causing uneven heating phenomenon, and the recognition that standing waves exist, there has been little or no appreciation of how such mechanisms can be advantageously applied to achieve desirable heating effects which heretofore have been unobtainable in microwave heating. In the past, there has been little or no recognition that the food substance can be positioned in a standing wave pattern to advantageously adjust the energy balance during microwave cooking.

In the past, food products such as breaded fish, breaded chicken, breaded vegetables, etc. have not been satisfactorily cooked in microwave ovens. In such products, it is desirable to have a crisp exterior surface. A crisp exterior surface is accomplished in a conventional oven where heating occurs from the impingement of a hot oven atmosphere to elevate the temperature of the surface of the food. In a microwave oven, however, the surface of the food substance is typically heated insufficiently by microwave absorption alone. It has been difficult in the past to achieve a crisp exterior surface in a microwave oven.

The hot oven atmosphere and temperature gradient established by a conventional oven tends to drive moisture from the surface of a breaded food product. The surface layers are initially rapidly raised to a higher temperature than the interior of a food product, which tends to enhance the crispness of the surface. This crispness has an important effect upon the sensory perception of a person who eats the food product. A breaded food product having a mushy surface tends to give a dramatically different and unacceptable taste sensation as compared with an otherwise identical food product that is crisp. The temperature characteristics of microwave heating tend to result in moisture being driven from the center of the food product to the surface, and inadequate heating of the surface to reduce the moisture content of the breaded surface to a sufficiently low level to be perceived as "crisp." Thus, the achievement of a crisp exterior surface in a microwave oven, especially in the case of breaded food products like fish which have a high moisture content, has been a problem in the past. Prior art attempts to obtain a crisp surface have been unsatisfactory.

Proper microwave cooking of food products to achieve a crisp surface involves a somewhat complex energy balance. For example, it is conceivably possible to continue cooking a breaded food product such as fish in a microwave oven long enough to crisp the exterior surface. However, this would normally result in an overcooking of the interior of the fish. An attempt could be made to increase the heating of the breaded and battered surface of the fish by increasing the amount of microwave energy that is absorbed either by increasing the cooking time or by increasing the power of the oven. But this would simultaneously increase the amount of microwave energy that is absorbed by the interior of the fish product to the point that the fish itself would be overcooked. This energy balance imposes constraints upon attempts to manipulate of the amount of microwave energy that is absorbed by the surface of the food. Increasing the cooking time or the power level of the microwave energy in order to crisp the exterior surface of the food substance is an unsatisfactory solution to the problem. Due to the cooking characteristics of microwave energy, in the example of breaded and battered fish products, it is desirable to slow down the heating of the interior of the fish and to increase the amount of heating of the exterior surface of the fish. Discovering how to do this has been a problem.

Microwave cooking must also deal with a much shorter moisture migration time. In a conventional oven, moisture migration from the center of the fish to the surface and evaporation into the oven atmosphere may occur over a 30 minute cooking period. In a microwave oven, the same fish fillet would be cooked in 3½ to 4 minutes. The heating process occurs much more quickly, and the moisture that is going to be released tends to pour out in a small amount of time. The breading coating does not absorb enough microwave energy to get itself hot enough to deal with all of the moisture that comes out of the fish, in order to vaporize the moisture or otherwise reduce the average moisture content sufficiently to result in a crisp surface. Thus, one of the very reasons that microwave cooking is convenient, i.e., rapid cooking time, is also a significant part of the problem of crisping food surfaces—it provides a much shorter moisture movement time. Achieving a crisp surface in such a short moisture movement time in a high moisture content food has been a problem in the past.

A crisp food product would seem to require crisping on all sides of the food product. One might think that crisping of breaded fish and the like in a microwave oven would at least require some means for flipping the fish over midway through the heating process. Alternatively, one might think that the only solution to the problem of crisping breaded fish would require some mechanism for simultaneously crisping all sides of a fish stick. U.S. Pat. No. 4,267,420, issued to Brastad, and U.S. Pat. No. 4,230,924, issued to Brastad et al., are examples of attempts to produce flexible wrapping material which was wrapped completely around a fish stick to brown the surface of the fish stick. Flexible wrapping material cannot be used as a self supporting heating platform. Moreover, surrounding a food substance with wrapping material tends to contain moisture which can give the food an overall impression of sogginess, especially where the wrapper material is relatively impermeable to moisture.

The need for a crisp surface should not be confused with prior attempts to accomplish "browning" of a food substance in a microwave oven. Browning is a different concept from crispness. Browning may involve placing grill marks or otherwise discoloring the surface of a food substance in an attempt to simulate the effects of a hot grill or radiation type heating such as broiling. Browning is concerned with the appearance of the food. "Crispness" involves obtaining certain physical qualities in the surface of the food substance so that the food product will produce a taste sensation characteristic of a crisp food product. Whereas "browning" appeals to the sense of vision, "crispness" appeals primarily to the senses of taste and touch.

One approach to solving the dilemma of producing food substances which have a crisp exterior surface is to provide a heating utensil which has at least one surface of the utensil which is a lossy heater, such as browning and crisping dishes. Some such heaters use ferrites on metals or semiconductors on ceramics as the lossy elements. Such heating utensils are permanent, nondisposable in nature, and employ heating elements that require preheating in order to work. For an example of a cooking utensil employing a lossy ceramic heater, see U.S. Pat. No. 3,941,967, issued to Sumi et al. The drawbacks of nondisposable ceramic heating elements are discussed in U.S. Pat. No. 4,283,427, issued to Winters et al. According to Winters et al., ceramic heating elements are expensive and add considerable bulk and weight to packaged products. Ceramic heating elements do not readily lend themselves to employment with disposable non-permanent packaging materials. According to Winters et al., ceramic heating elements may provide for uncontrolled (runaway) heating to elevated temperatures which can often result in scorching, charring and burning. While these types of browning and crisping dishes may have their place in microwave technology, they have considerable deficiencies for many uses.

It will be apparent from the above discussion that prior art attempts to achieve crisping of the surface of a food substance in a microwave oven have not been altogether satisfactory.

SUMMARY OF THE INVENTION

In accordance with the present invention, a system for heating a food substance in a microwave oven is provided which is operative to crisp one surface of the food substance. The food package system includes susceptor means responsive to microwave radiation for substantially heating the surface of the food substance that is desired to be crisp. The susceptor means is located in close proximity to or in direct contact with one surface of the food substance. The susceptor means generally comprises a sheet with a conductive coating, typically a metallized film, which absorbs microwave energy during exposure to microwave fields.

The susceptor means is thermally insulated from the bottom surface of the microwave oven. The susceptor means is preferably located within a high electromagnetic field intensity region of the microwave oven. Microwave energy typically originates from above the food substance, with the susceptor means located in direct contact with or in close proximity to the bottom surface of the food substance. In this arrangement of this invention, it has been discovered that only one side of the food substance may be exposed to the crisping action of the susceptor means, and yet the food substance will be perceived as having a high level of crispness when tasted by a consumer. For example, it has been discovered that in eating a piece of battered and breaded fish, crispness on one side is sufficient for high consumer acceptance as long as the other side is not soggy or mushy.

In order to achieve crispness of a food surface after microwave cooking, the moisture content of the surface of the food substance must be reduced to a sufficiently low level; or, where the moisture content of the surface is already sufficiently low, in order to maintain crispness the moisture content must be maintained at a sufficiently low level. Much of the moisture should be allowed to escape into the oven atmosphere. In one aspect of the present invention, the susceptor means becomes moisture permeable during at least a portion of the time that the food surface is exposed to microwave heating in order to allow the escape of moisture from the food surface. The invention further includes means for allowing the moisture that diffuses through the susceptor means to escape to oven atmosphere.

One embodiment of the present invention involves the use of a substantially solid, unbroken metallized layer that is responsive to microwave radiation and is significantly heated by microwaves. This continuous metallized film intensely heats the surface of the food substance. The surface of the food substance is preferably raised to a higher temperature than the interior of the food substance.

In this embodiment of the invention, a temperature sensitive support layer is provided for supporting the metallized film. When the metallized film reaches a sufficiently high temperature, (as it quickly heats the surface of the food substance and starts to vaporize moisture on the surface of the food substance), the support layer shrinks and forms cracks in the metallized film, thereby allowing moisture to diffuse through the metal layer. This action simultaneously reduces the responsiveness of the metallized layer to microwave radiation. The level of heating of the surface of the food substance drops after an initial period of relatively intense heating.

In another embodiment of the present invention, a metallized layer that is responsive to microwave radiation is provided which has preformed slots or moisture passageways therein. The slots allow moisture to diffuse through the metal layer to aid in crisping the surface of the food substance. The slots or moisture passageways are arranged so that the metallized layer is sufficiently responsive to microwave radiation to achieve an initial period of heating which is relatively intense.

In another aspect of the invention, a rigid face or sheet is provided. The support layer is adhesively affixed to the sheet. The sheet is moisture permeable and allows moisture to pass therethrough.

A preferred embodiment of the present invention includes thermal insulation means positioned between the metallized layer and the floor of the oven. This may take the form of a corrugated medium attached to the sheet. Flutes are formed in the corrugated medium which provide passageways allowing moisture to escape to the oven atmosphere.

In a narrower aspect of the present invention, a biaxially oriented heat set polyester layer is provided as the support for the metallized layer. A metal film is deposited on the polyester layer by vapor deposition. When the metal layer is heated by microwaves, it starts the crisping process by quickly elevating the temperature of the surface of the food substance. In this embodiment of the invention, the polyester layer then forms cracks in the metallized layer to simultaneously (1) form passageways that allow moisture to escape from the surface of the food substance to the oven atmosphere, and (2) create conductivity breaks in the surface of the metal film which decrease the responsiveness of the metal film to microwave radiation. The susceptor continues to heat after such breaks form, but the temperature of the susceptor will drop as the responsiveness to microwave radiation decreases.

Food substances, such as fish, have a high moisture content. Under microwave heating, internal moisture tends to migrate toward the surface of the food substance. The present invention controls this moisture migration which would otherwise adversely affect crispness.

The temperature gradient established during microwave cooking is improved by locating the susceptor means near a point of maximum field intensity in the oven. The food substance is then advantageously selected so that the center of the food will be at or near a field minimum. The energy balance during cooking is adjusted so that a high moisture content food substance, such as breaded and battered fish, may be heated by microwaves to produce a moist fish with a crisp surface.

BRIEF DESCRIPTION OF THE DRAWINGS

For a fuller understanding of the present invention, reference should be had to following detailed description taken in conjunction with the drawings, in which:

FIG. 1 is a perspective view of a breaded and battered fish fillet positioned on a microwave susceptor pad constructed in accordance with the present invention.

FIG. 2 is a cross-sectional view of a microwave susceptor pad in accordance with the present invention, resting on the floor of a microwave oven and having a food product placed thereon.

FIG. 3 is a cross-sectional close-up of a partially cut-away view of a portion of the microwave susceptor pad illustrated in FIG. 1.

FIG. 4 is an exploded partially cut-away perspective view of a portion of a microwave susceptor pad constructed in accordance with the present invention.

FIG. 5A is a perspective view of a microwave susceptor pad prior to heating.

FIG. 5B is a perspective view of the microwave susceptor pad illustrated in FIG. 5A, but after heating. Openings which formed in the pad during heating are illustrated.

FIG. 6 is a close-up cross-sectional view of a cut-away section of a microwave susceptor pad after heating.

FIG. 7 is a graph showing a plot of temperature versus time for (1) the bottom surface of a fish fillet, (2) the center of a fish fillet, (3) the top surface of a fish fillet, and (4) oven atmosphere for a food substance cooked in a microwave oven using a susceptor pad in accordance with the present invention.

FIG. 7A is a partially cut-away cross-sectional side view of a susceptor pad and fish fillet showing the placement of the probes used to measure the temperatures that are graphed in FIG. 7.

FIG. 12 is a perspective view of an alternative embodiment of a microwave susceptor pad.

FIG. 13 is a perspective view of an alternative embodiment of a microwave susceptor pad having preformed or pre-cut slots therein.

FIG. 13A is an enlarged partially cut-away top view of a portion of the susceptor pad shown in FIG. 13 illustrating the pre-cut slots.

FIG. 13B is an enlarged partially cut-away cross-sectional side view of the susceptor pad illustrated in FIG. 13A showing the slots in further detail.

DETAILED DESCRIPTION OF A PREFERRED EMBODIMENT OF THE INVENTION

Figure 9:
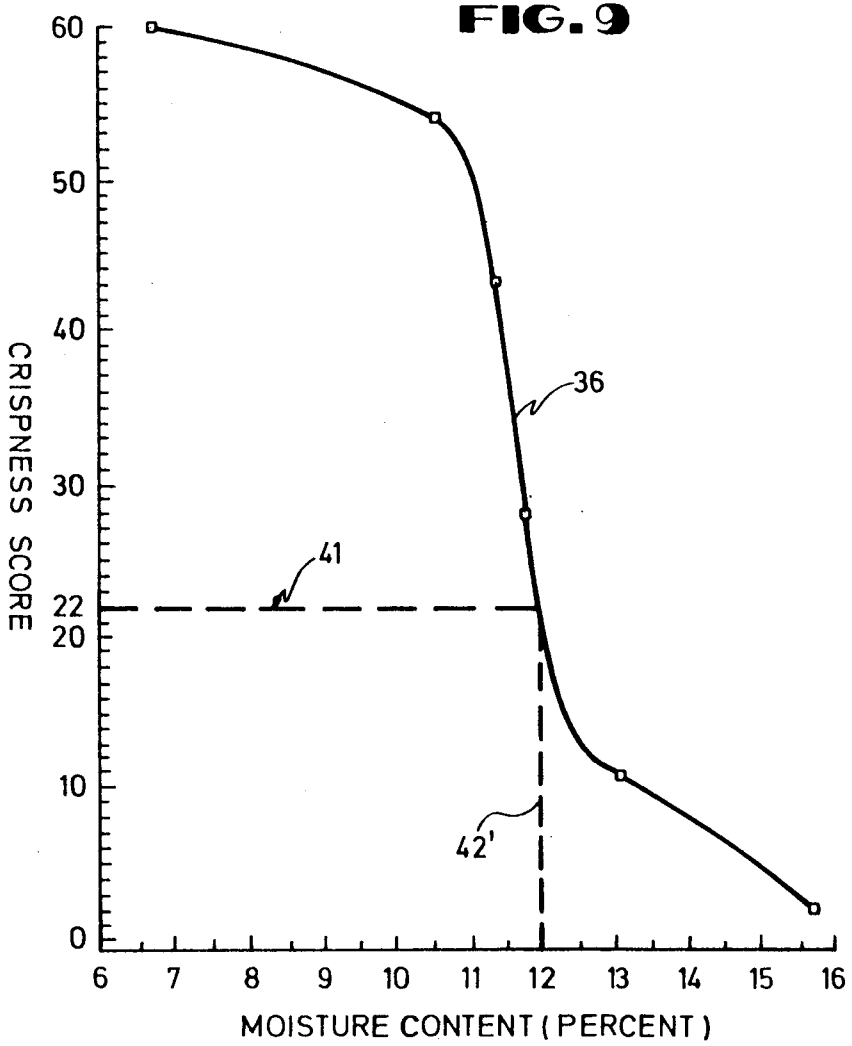
FIG. 9 is a graph showing the effect of moisture content upon the crispness of crumbs in a breaded and battered surface of a food substance.

In order to crisp a surface 21 of a food product 11, it is desirable to have some means for elevating the temperature of the surface 21 of the food substance 11 which is to be made crisp. A metallized film 16 is a possible means for elevating the temperature of the surface 21 of the food substance 11. A metallized film susceptor pad 10 which is responsive to microwave radiation, and which heats when exposed to microwaves, may be placed next to the surface 21 of the food substance 11 which is to be made crisp.

Significantly, it has been discovered that only one surface of the food substance 11 can be exposed to the susceptor pad 10, and the food substance 11 will still be perceived by a consumer as having an overall impression of crispness if the opposite surface 25 is not soggy or mushy.

However, merely heating the bottom surface 21 of the food substance 11 by placing a metallized heater in close proximity to it is insufficient to create a crisp surface 21. Moisture trapped between the food substance 11 and a moisture impermeable metallized heater would be substantially impeded from escaping. This moisture would normally prevent the surface 21 from becoming sufficiently crisp. In one embodiment, the metal sheet may preferably be a substantially continuous and integral sheet so that it will have sufficient susceptibility to microwave radiation to intensely heat the surface 21 of the food substance 11. A continuous sheet may be desirable to provide uniform even intensive heating of the surface 21 of the food product 11. But this creates a problem, because it is desirable to have some means for allowing the moisture to escape.

In accordance with one aspect of the present invention, a metal film 16 is deposited on a polyester support 15. The metal film 16 is initially continuous and uniform, and therefore relatively highly responsive to microwave radiation. The metal film 16 initially heats to a relatively high temperature, and starts the crisping process on the surface 21 of the food substance 11 by rapidly elevating the temperature of the surface 21 of the food substance 11. After an initial period of time of intensive heating, the polyester support layer 15 responds to the intense heating by opening a plurality of cracks 22 in the surface of the metal film 16. This action simultaneously provides passageways 22 for the escape of moisture and also reduces the responsiveness of the metal film 16 to microwave radiation. This combination of a metal film 16 with a temperature sensitive polyester support layer 15 facilitates a unique two-step crisping procedure that effectively results in a crisp surface 21 of the food substance 11. These and other aspects of the invention will be described more fully below in connection with the figures of the drawings.

Turning now to the figures, and starting first with FIG. 1, there is shown a partially cutaway perspective view of a packaging system which includes a food product 11, such as a fish fillet, a susceptor pad 10, and a tray 26. In one embodiment of the invention, the fish fillet 11 is placed in a microwave oven while positioned as shown in the tray 26, resting upon the susceptor pad 10. In the illustrated embodiment, the fish fillet is microwaved for 3½ to 4 minutes.

FIG. 2 shows a cross-sectional view of a microwave susceptor pad 10 in accordance with the present invention. In a preferred embodiment, a food product 11 rests on top of the susceptor pad 10. The food product 11 may advantageously be a breaded and battered food product such as breaded fish, breaded chicken, breaded vegetables, or a food product where it is desirable to have a crisp surface. The present invention is particularly advantageous where the food substance 11 has a high moisture content, like fish. The susceptor pad can rest upon the floor 12 of a microwave oven. Most microwave ovens contain a reflective surface 13, typically the oven cavity, which tends to reflect microwave energy.

As shown more clearly in FIG. 3, the susceptor pad 10 is formed from several layers of material. Referring to FIG. 3 and the exploded view of FIG. 4, the susceptor pad 10 preferably includes a layer of metallized polyester 14. The metallized polyester layer 14 comprises a polyester sheet 15, and a layer of metal or other conductive material 16. A layer of adhesive 17 is also included to bond the metallized polyester layer 14 to a supporting surface. The metallized polyester layer 14 is immediately adjacent to, and in contact with, the food product 11.

The layer of metallized polyester 14 is preferably laminated to a relatively rigid face of uncoated paperboard 18. The paperboard 18 is moisture permeable. The face 18 has sufficient moisture permeability to allow enough moisture to move through the face 18 during microwave cooking so that the surface 21 of the food product 11 can be made crisp or can be maintained as crisp.

It is desirable to thermally insulate the layer of metallized polyester 14 from the oven floor 12. In accordance with the present invention, a layer of corrugated medium 19 is attached to the face 18 by a layer of adhesive 20. This provides effective thermal insulation from the oven floor 12. The corrugated medium 19 also functions as a rigid support. The susceptor pad 10 is preferably not flexible.

Referring now to FIG. 2, in practice the metallized polyester layer 14 is in direct contact with the food substance 11. The corrugated medium 19 may rest on the floor 12 of the microwave oven. Alternatively, it may be in a tray 26, as shown in FIG. 1. The oven cavity 13, some distance below the floor 12 of the oven, forms a reflective surface which reflects microwave energy back toward the food substance 11. This is illustrated in FIG. 2. In a preferred operation of the present invention, the conductive layer 16, (preferably a thin layer of metal), is positioned approximately ¼ wavelength above the reflective surface 13. In most applications, a spacing of approximately ¼ wavelength will give satisfactory results. The invention may be used even where the spacing is significantly different from ¼ wavelength, or an odd multiple thereof. However, results are best when the metallized polyester layer 14 is spaced from the reflective surface 13 approximately ¼ wavelength.

It will be appreciated that the wavelength is determined by the frequency of the microwave radiation inside the microwave oven, and the speed of the microwave energy through the medium. The wavelength will be different depending upon the medium. For example, the wavelength in air 42 is different from the wavelength in the fish 11. In this context, "wavelength" should be understood to mean the actual wavelength according to the various mediums involved. The actual wavelength is sometimes referred to as "$\lambda_1$".

By spacing the metallized layer 16 approximately ¼ wavelength above the reflective oven cavity 13, the metal layer 16 will be at a maximum point of the electrical field. As stated above, this should be understood to be the actual ¼ wavelength point, taking into consideration the various layers of medium through which the microwave radiation may pass. This configuration may be thought of as establishing a standing wave where the microwave radiation coming from a source above the food product 11 strikes the bottom of the oven cavity 13 and is reflected back toward the food product 11.

It is desirable to have the metal layer 16 positioned in a region of maximum field intensity in the microwave radiation. Best results are obtained when the conductive layer 16 is at the point of maximum electric field. Where the reflective surface 13 is a flat planar surface, the region of maximum field intensity will generally define a plane parallel to the reflective surface 13 and spaced ¼ wavelength away. This may be referred to as the plane of maximum field intensity. A region of maximum field intensity will repeat every ½ wavelength thereafter in the direction perpendicularly away from the reflective surface 13. The position of the metal layer 16 may be adjusted by varying the height "H" of the corrugated medium 19. Good results are obtained when the metallized layer 16 is positioned in a plane parallel to the reflective surface 13, that is within plus or minus 3 dB of the maximum field intensity. Better results are obtained when the metallized layer 16 is positioned in a plane that is within plus or minus 1 dB of the maximum field at the plane of maximum field intensity.

Alternatively, the metallized layer 16 is preferably positioned at a distance between about 0.15 wavelength ("$\lambda$") and about 0.35 wavelength ("$\lambda$") from the reflective surface 13. The metallized layer 16 is more preferably positioned at a distance between about 0.2$\lambda$ and about 0.3$\lambda$ from the reflective surface 13. The metallized layer 16 is even more preferably positioned at a distance between about 0.23$\lambda$ and about 0.27$\lambda$ from the reflective surface 13. An especially preferred position for the metallized layer 16 is at a distance between about 0.24$\lambda$ and about 0.26$\lambda$ from the reflective surface 13. The most preferred position for the metallized layer 16 is at a distance of about 0.25$\lambda$ from the reflective surface 13.

The actual wavelength, which we will designate for purposes of discussion as "$\lambda_1$", will normally be less than the wavelength of the microwave energy in free space. The relationship may be expressed as $\lambda_1 = k\lambda_0$, where "$\lambda_1$" is the actual wavelength, "k" is a correction factor, and "$\lambda_0$" is the wavelength of microwaves in free space.

The wavelength of microwaves in free space may be expressed as $\lambda_0 = 11{,}800 \div f$, where "$\lambda_0$" is expressed in inches, and "f" is the frequency of the microwaves in megahertz. While 915 MHz is permitted in North and South America by regulatory authorities, as well as other frequencies, most of the commercially available microwave food processing equipment is designed for operation at 2450 MHz. Virtually all home microwave ovens operate at a frequency of 2450 MHz. Thus, $\lambda_0$ is about 4.82 inches at the frequency of interest.

In typical ovens, a height "H" between ⅛ inch and ⅜ inch has given satisfactory results in practice. In some cases a height "H" of ½ inch has given satisfactory results. The height "H" will depend upon the spacing of the reflective surface 13 below the floor 12 of the oven.

The metallized layer 16 absorbs microwave energy. When exposed to microwave radiation, the metallized polyester layer 14 becomes hot, and thereby heats the exterior surface of the food product 11. If the metallized layer 16 is located in a region of maximum field intensity, it will be heated the maximum amount possible in that particular microwave oven.

Because the metallized polyester layer 14 is located at or near a maximum in the electrical field, the intensity of the electrical field diminishes in the direction toward the center 27 of the food product 11, until a minimum is reached at a distance ½ wavelength from the reflective surface 13. Alternatively stated, a minimum is reached at a point ¼ wavelength from the maximum, (and the metallized layer 16 is preferably located at the maximum.) To the extent that the heating of the food substance 11 is proportional to the square of the strength of the electric field, this configuration of the electric field tends to establish a temperature gradient through the food substance 11 which is greatest at the surface 21 in contact with the metallized polyester layer 14 and which diminishes toward the center 27 of the food product 11. Of course, the actual wavelength of the microwaves within the food substance 11 should be understood to be meant here. The wavelength $\lambda_1$ of microwaves through the food substance 11 will typically be shorter than the wavelength $\lambda_0$ in free space, (or the wavelength in air which is very nearly the same as $\lambda_0$). This is illustrated in FIG. 2.

The wavelength $\lambda_1$ will be affected by the dielectric properties of the food substance 11. The dielectric properties of a food substance 11 may be measured using techniques which are known in the art. For example, a Hewlitt Packard 8753A microwave network analyzer may be used. Once the dielectric of the food substance 11 has been measured, the wavelength $\lambda_1$ of the microwaves within the food substance 11 may then be calculated.

The wavelength $\lambda_1$ may be calculated based upon the following relationship:

$$\lambda_1 = 2\lambda_0\sqrt{\frac{1}{2E'((1 + (\tan\Delta)^2)^{\frac{1}{2}} + 1)}}$$

where $\lambda_0$ is the wavelength of the microwaves in free space;

E′ is the dielectric constant (which can be measured);

E″ is the dielectric loss factor (which can be measured); and, tan Δ is the loss tangent. The loss tangent is equal to $$\frac{E'}{E'}.$$

By measuring E′ and E″, the wavelength $\lambda_1$ of the microwaves within the food substance 11 may be calculated.

The interior of the food substance 11 will typically have a different dielectric constant from the coating 21.

The center 27 of the food substance 11 is preferably positioned between about 0.40 wavelengths and about 0.60 wavelengths from the reflective surface 13. The center 27 of the food substance 11 is more preferably positioned at a distance between about 0.45λ to about 0.55λ from the reflective surface 13. The center 27 is even more preferably positioned at a distance between about 0.48λ to about 0.52λ from the reflective surface 13. An especially preferred position for the center 27 of the food substance 11 is at a distance between about 0.49λ and about 0.51λ from the reflective surface 13. The most preferred position for the center 27 is at a distance of about 0.5λ from the reflective surface 13.

For multi-layered products such as battered and breaded fish, it is convenient to calculate the food thickness as multiples of wavelengths in the individual layers. The sum of these multiples of wavelengths are then set to equal the desired wavelength multiples. The number of wavelengths in a layer is determined by thickness of layer divided by $\lambda_1$. As an example, for cod which may have $\lambda_{1cod}=2.02$ cm for the coating which may have $\lambda_{1coating}=4.45$ cm, the thicknesses of 0.3 cm for the coating and 0.7 for the cod results in a wavelength equivalent to:

$$\frac{0.3}{4.45}+\frac{0.7}{2.02}+\frac{0.3}{4.45}=0.482 \text{ wavelengths}$$

The above-described positioning of the metallized film 16 and center 27 of the food substance 11 within the electrical field tends to establish desirable temperature gradients in the food substance 11 to produce a crisp breaded surface 21 at the bottom of the food substance 11. It also sets up an energy balance which will result in a crisp exterior surface 21 and a moist interior of the fish 11. The breaded surface 21 is heated more quickly than the center 27 of the food substance 11. The metallized susceptor 10 significantly aids in this heating effect, because it becomes relatively hot, especially during the initial period when it is exposed to microwave radiation.

Although the heating effect of the metallized coating 16 is important in achieving a crisp breaded surface 21 on the food substance 11, moisture control is also of great significance in achieving the desirable attributes in the food substance 11. In order to provide a crisp surface 21, moisture must be reduced in bread crumbs in the breaded surface 21 below a certain level. Generally speaking, the crispness of the surface 21 is inversely related to the amount of moisture in the surface 21. Moisture which is usually present when the food substance 11 is initially placed into the oven must be allowed to escape.

In a conventional oven, when a breaded food substance is heated, moisture in the surface is allowed to escape into the oven atmosphere. The moisture is typically driven off by the elevated temperature of the air inside the conventional oven. When viewed as a function of time, the temperature of the center of the food substance lags behind the temperature of the surface of the food substance in a conventional oven, at least until thermal equilibrium is established. Thus, in the initial stages of heating, as moisture is being driven off from the surface of the food substance in a conventional oven, the center of the food substance is not being heated so quickly that moisture from the center quickly replaces the moisture that is being removed from the surface. This perhaps sometimes complicated movement of moisture within the food substance is believed to contribute significantly to the crispness of the surface of the food. Moveover, the movement of moisture occurs slowly, over a period of perhaps 30 minutes.

In a microwave oven, in the absence of the present invention, the center of the food substance would tend to heat very quickly, and perhaps even more quickly than some surfaces of the food. Moisture from the center of the food would be driven out toward the surface. Typically, the surface would not be heated hot enough relative to the center of the food substance to achieve a crisp surface without adversely affecting the quality of the food substance as a whole. This is especially true in the case of high moisture content foods, such as fish. High moisture content foods may be considered to be food substances having about 10% or more ice by weight of the food substance 11 at −40° F. as measured by DSC (differential scanning calorimetry).

In the present invention, merely heating the surface 21 of the food substance 11 may be insufficient to achieve a desirably crisp surface 21 if moisture is not also allowed to escape. The desirability of using a continuous sheet of metal 16 in one embodiment of the invention to provide even heating and to provide maximum initial heating of the surface 21 of the food 11, creates a problem with moisture control.

One aspect of the present invention utilizes moisture control features which greatly enhance the crispness of the surface 21 of the food substance 11. In the present invention, the metallized polyester layer 14 has a moisture transmission characteristic when exposed to microwave heating which can be used to advantage to achieve crispness. Referring to FIG. 5A, the metallized polyester layer 14 is in the form of a generally uniform, continuous, solid surface prior to exposure to microwave radiation. When exposed to the heating effects of microwave radiation, the polyester and metal layers (15 and 16 respectively) form numerous cracks 22 over the surface of the susceptor pad 10, as shown in FIG. 5B. A plurality of cracks 22 allow moisture to escape from the surface 21 of the food substance 11, and to move through the metallized polyester layer 14. The face of paperboard 18 allows moisture to move therethrough. The moisture is allowed to escape through flutes 23 formed by the corrugated medium 19. The moisture then disperses in the atmosphere 24 of the microwave oven interior.

By allowing moisture to be driven from the surface 21 of the food substance 11, the crispness of the breaded food product 11 is greatly enhanced.

As the cracks 22 form in the surface 14 of the susceptor pad 10, the electrical continuity of the metal layer 16 is broken into regions having smaller effective electrical dimensions. This greatly reduces the heating effect of microwave radiation upon the metal layer 16. The cracks eventually make the metal layer 16 less responsive to microwave radiation. As a result of the cracks 22, the temperature of the metal layer 16 drops after a period of intense heating when it is initially exposed to microwave radiation. This tends to provide a control which prevents overheating of the layer 21 of the food substance 11. In other words, the cracks 22 tend to "turn off" the heating effect of the susceptor pad 10.

Thus, the surface 21 of the food substance 11 goes through a cycle where it is initially heated very strongly by the metal layer 16 of the susceptor pad 10. Then, as moisture in the surface 21 turns into steam, cracks 22 form in the surface layer 14, simultaneously allowing the moisture to escape through the flutes 23 of the corrugated material 19, and reducing the level of heating of the crisp surface 21.

In practice, the invention has been very successful in crisping battered and breaded fish such as cod. A preferred embodiment of the food substance 11 is disclosed in an application entitled "Battered and Breaded Products", by Victor T. Huang, et al., which is attached hereto, the entirety of which is incorporated herein by reference. That application was filed contemporaneously herewith on July 6, 1987, and was assigned Ser. No. 070,288, now abandoned.

The corrugated medium 19 serves a dual function. Initially during the heating phase of the two step crisping process, it provides thermal insulation of the hot metal layer 16 from the floor 12 of the oven. During the moisture escape phase of the crisping process, the flutes 23 in the corrugated medium 19 allow moisture to escape to oven atmosphere 24.

FIG. 6 is a close-up cross-sectional view of the metallized polyester layer 14 and the paper face 18 after the cracks 22 have formed. Moisture is permitted to move through the metallized layer 16 and the polyester sheet 15 by moving through the passageways formed by cracks 22. The paper face 18 is moisture permeable, and moisture is allowed to move through the paper face 18 and escape. The moisture eventually escapes to open atmosphere 24 by moving through the flutes 23 in the corrugated medium 19.

FIG. 7 illustrates the temperature as a function of time during microwave heating of the bottom surface 21, the center 27 of the food substance 11, the top surface 25, and the oven atmosphere 24. The temperature profile represented by FIG. 7 involved a fish fillet heated in a microwave oven for four minutes using a susceptor pad 10 constructed in accordance with the present invention.

FIG. 7A illustrates the location of temperature probes which were used to produce the graph of FIG. 7. The curve identified with reference numeral 28 in FIG. 7 was produced by temperature probe 43 shown in FIG. 7A. Curve 29 was produced by temperature probe 44. Curve 30 was produced by a temperature probe 45. Curve 31 shown in FIG. 7 was produced by temperature probe 46 shown in FIG. 7A.

Line 40 shown in FIG. 7 corresponds with a temperature of about 160° F. The cooking process must be sufficient to raise the fish 11 above 160° F. in order to properly cook the fish 11.

The power to the microwave oven was turned on at a heating time equal to 0 seconds. As shown in FIG. 7, the temperature of the bottom surface 21 of the food product 11 was rapidly elevated to a high temperature, about 250° F., within about 50 seconds. This is shown by curve 28. As cracks 22 formed in the metallized layer 16, the temperature of the susceptor 10 dropped. Consequently, the temperature of the lower surface 21 of the food product 11 also dropped. The temperature of the lower surface 21 continued to decline until a heating time of about 130 seconds had been reached.

Figure 8:
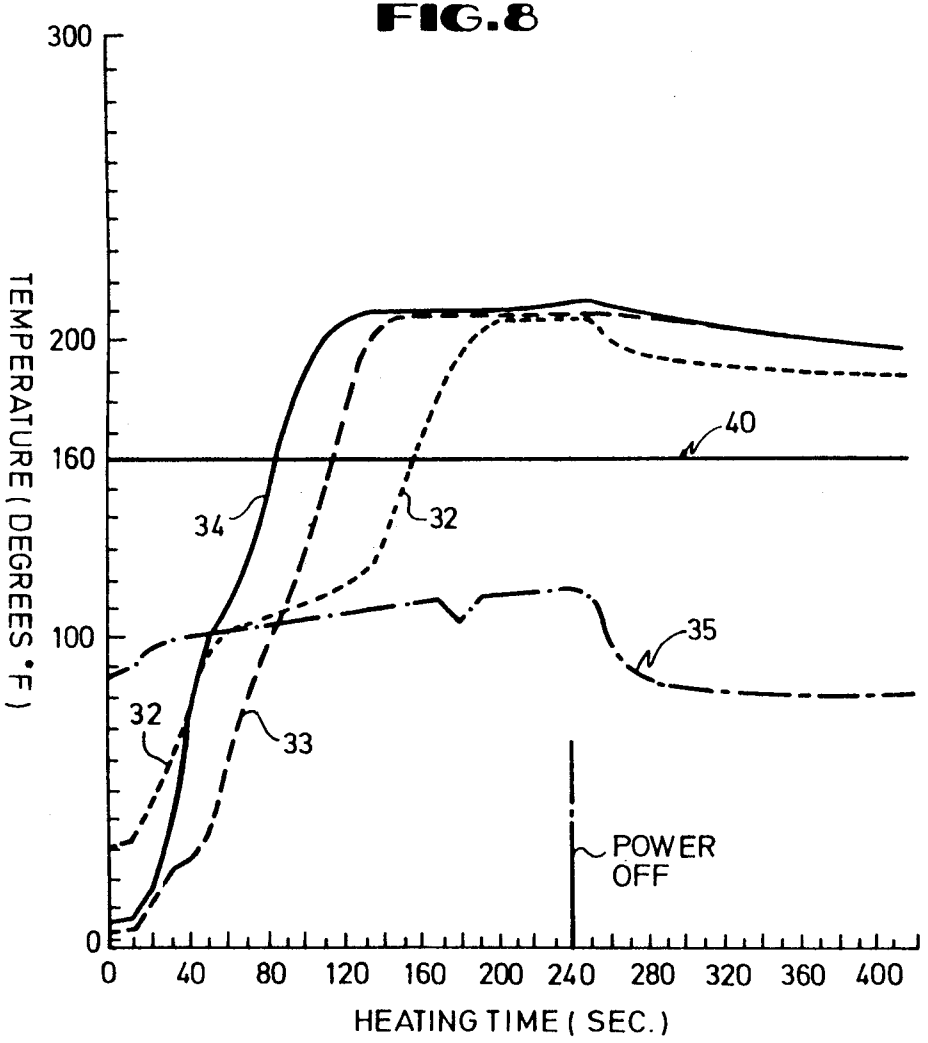
FIG. 8 is a graph similar to that illustrated in FIG. 7, except that the fish fillet was cooked without using a susceptor pad.

The remainder of curve 28 after a heating time of about 140 to 160 seconds generally conforms to the heating curve 32 shown in FIG. 8 for the lower surface 21 without a susceptor pad 10. In other words, at a heating time of about 140 to 160 seconds, the temperature of the lower surface 21 began to rise again, probably as a result of absorption of microwave energy without regard to the susceptor pad 10.

Curve 29 shown in FIG. 7 represents the temperature of the center 27 of the food product 11. It will be seen from FIG. 7 that the susceptor pad 10 effectively raises the temperature of the surface 21 of the food product 11 to a point which is substantially greater than the temperature of the center 27 of the food product 11. This simulates the type of temperature gradient or temperature differential which occurs in a conventional oven. The temperature of the bottom surface 21 is elevated sufficiently high to reduce the average moisture content of the bottom surface 21 so that the surface 21 will be perceived as crisp by a consumer.

Curve 30 represents the temperature of the top surface 25 of the food substance 11. This top surface 25 was heated sufficiently so that it was not soggy. Curve 31 in FIG. 7 represents the temperature of the oven atmosphere 24. The microwave energy was turned off at a heating time of 240 seconds. The temperature of the oven atmosphere 24 gradually rose to about 115° F., and then dropped quickly when the microwave energy was turned off.

The bottom surface 21 was elevated above 212° F. for several seconds during the initial phase of the crisping cycle. Significantly, this occurred before the center 27 was elevated above 200° F. Thus, the moisture content of the bottom surface 21 could be substantially reduced before significant moisture movement from the center 27 began to occur. This timing of the relative temperatures of the bottom surface 21 and the center 27 is believed to be important in the crisping process.

FIG. 7 also illustrates how the metallized layer 16 became less responsive to microwave radiation after an initial period of intense heating. This is believed to correspond with the formation of cracks 22 in the surface of the metallized layer 16. The temperature of the susceptor pad 10 began to drop after about 50 seconds.

FIG. 8 represents the heating profile for a substantially identical cod fish fillet without a susceptor pad 10. Curve 32 represents the temperature of the bottom surface 21 of the food product 11. Curve 32 started at substantially the same point as in FIG. 7, rose approximately to the temperature of the oven atmosphere 24, (represented by curve 35), and substantially leveled off for several seconds. The curve 32 then began to rise again at a heating time of about 140 seconds and leveled off at about the same temperature as the center 27, (represented by curve 33), and the top surface 25, (represented by curve 34).

The temperature of the oven atmosphere 24, shown by curve 35 in FIG. 8 is virtually the same as in FIG. 7. The temperature of the top surface 25, shown by curve 34 in FIG. 8, is virtually the same as FIG. 7. The temperature of the center 27 of the food substance 11, shown by curve 33 in FIG. 8, is virtually the same as in FIG. 7.

FIG. 8 shows why the bottom surface 21 ended up where it was not crisp, when the fish fillet was heated without a susceptor pad 10. The bottom surface 21 was not heated to a sufficiently high temperature to sufficiently reduce the moisture content of the surface 21. Moreover, the center 27 tended to reach a hot temperature more quickly than the bottom surface 21. Significantly, the temperature of the center 27 exceeded 200° F. before the temperature of the bottom surface reached 200° F. Moisture was driven from the center 27 towards the bottom surface 21 of the food substance 11 before the moisture content of the bottom surface 21 was reduced. The temperature of the bottom surface did not exceed 200° F. until late in the heating cycle, (after about 170 seconds). By then it was too late.

A comparison of FIG. 7 and FIG. 8 shows that the susceptor pad 10 is effective to substantially increase the initial temperature of the surface 21 of the food substance 11 to reduce the moisture content of the surface 21. This is done before the temperature of the center 27 reaches 200° F. The susceptor pad 10 is also effective to allow moisture to escape from the surface 21 of the food substance 11.

FIG. 9 illustrates the effect of average moisture content by weight of bread crumbs in the breaded and battered layer 21 of the food substance 11 upon crispness. As moisture content increases above about 10%, the perceived crispness of the food substance 11, represented by a crispness score, drops rapidly. In FIG. 9, a crispness score of 22 is believed to be the cut-off point for acceptable crispness. This is represented in FIG. 9 by dashed line 41. This corresponds to a moisture content of about 12%, as shown by dashed line 42' in FIG. 9. In order for a breaded and battered product to be generally perceived as crisp, the average moisture content of the bread crumbs should be less than about 12%. An average moisture content between about 13¾% and about 18% generally produces marginal taste perceptions. When a crispness level is achieved corresponding to an average moisture content less than about 12%, the results are good. Better results are obtained when an average moisture content of less than about 11% is obtained. More preferred results are obtained when an average moisture content of less than about 10½ percent is obtained. Especially preferred results are achieved when an average moisture content less than about 10% is obtained. Most especially preferred results are achieved when an average moisture content of less than about 9% is obtained. A moisture content more than 18% is considered to be soggy or mushy.

The metallized polyester adhesive layer 14 must comply with all appropriate FDA requirements, because it will be in direct contact with the food substance 11. Of course, the susceptor pad 10 will be subjected to high temperatures, (e.g., 160° F. to 450° F.), typically for up to 4 minutes with the food product 11 on the susceptor pad 10. A temperature range of about 350° F. (about 177° C.) to about 425° F. (about 218° C.) is preferred. The metallized polyester layer 14 may be aluminum metallized food grade 48 gauge biaxially oriented heat set polyester.

Aluminum works well for the layer of metal 16. The conductive layer 16 may be a coating applied to the polyester sheet 15 by a deposition process, such as vapor deposition. Thin film metallizing can be done by various techniques such as sputtering, cathodic arc deposition, chemical vapor deposition, electrochemical depositing, vacuum evaporation, vapor deposition, etc. Aluminum may be satisfactorily deposited by vapor deposition. Other materials, such as gold, silver, chromium, or tin oxide, and conductive compositions, such as graphite, may also work, but aluminum is preferred because of cost and it works well in vacuum depositions processes, (e.g., good vapor pressure, etc.). The layer 16 can be any conductive material that is responsive to microwave radiation to heat the surface of a food substance 11, and which is safe to use in a food preparation context. An aluminum coating layer 16 that is less than about 700 angstroms thick will give satisfactory results.

The metal layer 16 should preferably have a resistivity between about 40 to about 300 ohms per square, (measured prior to exposure to microwave energy). The metal layer 16 may have a transmission optical density between 0.13 and 0.27 (preferably 0.20). The metal layer 16 may have a reflectance optical density (20°) between 0.39 and 0.61, (preferably 0.50).

The metal layer 16 is preferably a thin planar sheet oriented in a plane parallel to the surface 21 of the food product 11. This conductive film 16 should be positioned closely to the surface 21 of the food substance 11 to efficiently heat the surface 21. The metal layer 16 is preferably positioned in a plane parallel to the reflective surface 13 of the oven.

The polyester sheet 15 is preferably 0.00048 inch thick. The polyester sheet 15 is preferably biaxially oriented heat set polyester.

The face 18 may be 18 point paperboard. Uncoated solid bleached sulfate board stock has given satisfactory results in practice. The metallized polyester layer 14 is adhesively fixed to the sulfate board stock 18 by an adhesive 17. Adhesives having a bond strength to the paperboard 18 between, 0.23 pounds per inch and 0.85 pounds per inch have given satisfactory results in practice.

The face 18 may be approximately 216 pounds per 3,000 square feet basis weight paperboard. A face layer 18 having a thickness of 0.0185 inch has given satisfactory results in practice.

Alternatively, the face 18 may be any rigid moisture permeable medium capable of supporting the metallized polyester layer 14. As discussed above, moisture permeable means that the medium allows enough moisture to move through it during microwave cooking so that the surface 21 of the food product 11 can be made crisp or can be maintained as crisp. The face 18 also holds the corrugations 19 firm and prevents them from stretching or flattening.

The susceptor pad 10 is preferably a rectangular cut single faced corrugated pad 10. A rectangular susceptor pad 10 having a length of 6.75 inches by 3.25 inches has given satisfactory results in practice. The corrugated direction is preferably lengthwise. However, good results may also be obtained with other shapes or with other corrugated directions. Approximately 50 flutes per lineal foot may be used for the corrugated medium 19 with satisfactory results. An approximate flute height of 3/32 inch will normally give satisfactory results. A standard B-Flute can be used with satisfactory results. Other flute sizes and spacings are also believed to be functional in accordance with the present invention, the present disclosure being primarily directed to a preferred embodiment of the present invention.

The corrugated medium 19 may be white bleached kraft paper. Fifty pound paper, (i.e., 50 pounds per 3,000 square feet basis weight), used as the corrugated medium 19 has given satisfactory results in practice. Single face corrugated fiberboard is preferred.

Any package configuration which spaces the metallized layer 16 from the floor 12 of the oven, and which provides thermal insulation for the metallized layer 16, may work. The thermal insulation means may take the form of a raised lip around the perimeter of a sheet, where the lip rests upon the floor of the oven and raises the sheet up so that it is spaced a distance from the floor of the oven. The thermal insulation means may also take the form of legs, of embossed, molded, or raised projections, of false bottom packaging configurations, of spacers, or of other package configurations which provide thermal insulation of the metallized layer 16 from the floor 12 of the microwave oven.

The physical mechanism for creating cracks 22 in the metallized polyester layer 14 during microwave radiation may not be completely understood. The polyester 15 is formed as a web, and may be thought of as an oriented film. The polyester sheet 15 is manufactured from a process where it was stretched in two orthogonal directions during manufacture. When such an oriented material is heated, the material tends to relax back to its original condition.

In addition, the polyester sheet 15 is glued or adhesively affixed to a paper sheet or paperboard 18. The paperboard 18 adds rigidity to the structure of the susceptor pad 10. During exposure to microwave radiation and heating, while the polyester sheet 15 is shrinking due to the heating effects, the paper face 18 substantially remains in its original size and dimension, or possibly grows slightly due to thermal expansion and absorption of water. In other words, the paperboard face 18 is relatively dimensionally stable during heating as compared to the polyester 15. The polyester sheet 15 is, of course, heated by the metal coating 16 on its surface. The temperature attained by the metallized polyester layer 14 may reach the softening point of the polyester sheet 15. One characteristic of the polyester material 15 is that it loses much of its strength as it softens when it is heated. Combining this phenomenon with the tendency of the polyester web to shrink and its adhesive fixation to a paperboard sheet 18 which does not shrink, tends to create the formation of cracks 22 in the polyester material over its surface area. Because the metal layer 16 is deposited on the polyester sheet 15, the cracks in the polyester sheet 15 also result in cracking or breaking apart of the metal coating 16 deposited on the polyester sheet 15.

Once the polyester 15 is ruptured, moisture can move readily through the cracks 22. Water migration continues through the paperboard 18 because of its porous nature and natural tendency to allow moisture to pass therethrough.

A breaded food product 11 having a thickness equal to ½ wavelength of the microwave radiation in the product is preferred. Because a maximum in the electric field occurs at the surface of the susceptor pad 10, if the thickness of the food product 11 is equal to ½ wavelength, a minimum of the electric field will occur in the center 27 of the food product 11. This is desirable to reduce the amount of heating occurring at the center 27 of the food substance 11 as compared to the breaded surface 21 of the food substance 11. This will enhance the crispness of the breaded surface 21.

Of course, it must be recognized that the wavelength which is intended here is the wavelength $\lambda_1$ of the microwave radiation in the food product itself. The wavelength of microwaves varies depending upon the substance through which the microwaves pass. This is due to the fact that the speed of electromagnetic radiation, (commonly referred to as the speed of light), varies depending upon the material through which the electromagnetic radiation moves. The wavelength of the microwave radiation may change in the breading and batter coating 21 as compared with the wavelength in the fish or other food product 11. The preferred thickness for the breading and batter is about 0.3 centimeter. The preferred thickness for cod, where that type of fish is used as the food substance 11, is about 0.7 centimeter. A product thickness of about 1.5 centimeters for fish with a breading batter layer of about 0.3 centimeter has given satisfactory results in practice. A combination of a 1.5 centimeters thick fish and a breading layer of 0.3 centimeter results in a positioning of the center 27 a distance of about 0.43 wavelengths from the surface of the susceptor pad 10.

Through experimentation, it has surprisingly been discovered that satisfactory results may be obtained where only the bottom surface 21 of the food product 11 is made crisp in accordance with the present invention. It has been discovered that satisfactory food quality and taste may be achieved without flipping the food product 11 during microwave cooking. Experimentation has shown that consumers will accept a product as crisp if one side 21 of the food product 11 is crisp and the opposite side is at least not soggy. Under such circumstances, the consumer perceives the food product 11 as crisp. For example, crisp is generally considered to be less than about 12% moisture, (see FIG. 9), while soggy or mushy is generally considered to be greater than about 18% moisture. Thus, a consumer will perceive a breaded and battered food product 11 as crisp if the average moisture content of the lower surface 21 is less than about 12%, and the average moisture content of the upper surface 25 is less than about 18%.

Figure 10:
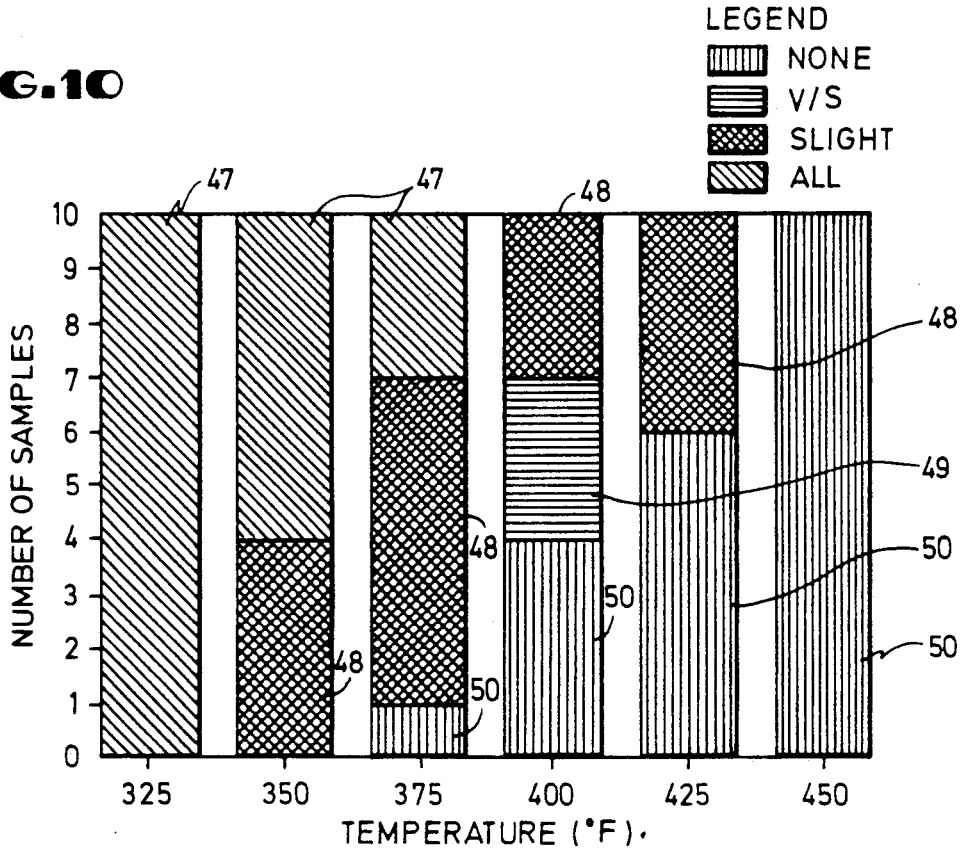
FIG. 10 is a bar chart illustrating temperature measurements taken on ten susceptor pads which were tested.

FIG. 10 is a bar chart illustrating the results of an experiment attempting to determine the maximum temperature that a susceptor pad 10 reaches underneath a fish 11 during a normal cooking cycle, (i.e., 3 minutes and 30 seconds). Breaded and battered light cod was used as the food substance 11. The fish fillet 11 was placed on a susceptor pad 10, as illustrated in FIG. 2.

Melting point standards in crystal granular form, manufactured by Omega Engineering, Inc., were used to determine the temperature reached by the susceptor pad 10. The Omega melting point crystals were placed in three points along the center line of the susceptor 10. A piece of 50 gauge polyester was placed over the crystals to keep them dry, and the fish fillet 11 was placed on top. The melting point standard crystal material was positioned between the fish fillet 11 and the susceptor pad 10.

The Omega melting point crystals are supplied in temperature increments of 25° F. Omega claims that the melting point crystals have an accuracy of ±1° F. According to Omega, when the very first signs of melting appear, the temperature rating of the crystals has been reached. Thus, the crystals are examined after heating to determine if any of them have melted. If so, the temperature rating of the crystals was reached during heating.

After the fish fillet 11 was cooked for 3 minutes and 30 seconds, (the fish fillet 11 was not flipped), the crystals were observed and rated as follows:

"None"—no crystals melted;

"V/S"—very slight; individual crystals melted;

"Slight"—small congregates of crystals melted but not an entire pile;

"All"—one or more of the piles melted completely.

Ten susceptor pads 10 were tested in each crystal range, starting at 325° F., in 25° F. increments up through 450° F. The results are summarized graphically in FIG. 10.

The area of the bar chart identified with reference numeral 47 indicates samples of susceptor pads where all of the crystals in one or more of the piles melted completely. At 375° F., this occurred with three of the susceptor pads 10. At 350° F., this occurred with six of the susceptor pads 10. At 325° F., this occurred with ten of the susceptor pads 10.

The area of the bar chart shown in FIG. 10 which is identified by reference numeral 48 indicates the number of samples where a slight melting of the crystals occurred. Such slight melting is sufficient to indicate that the temperature rating of the crystals had been reached. This occurred with four of the susceptor pads at 350° F. At 375° F., this occurred with six of the susceptor pads 10. At 400° F., this occurred with three of the susceptor pads 10. At 425° F., this occurred with four of the susceptor pads 10.

The area of the bar chart shown in FIG. 10 which is indicated by reference numeral 49 represents samples where very slight melting occurred. This represents an experimental observation where individual crystals melted. This is still a sufficient indication that the temperature rating of the crystals had been reached. At 400° F., this occurred in three of the susceptor pads 10.

The area of the bar chart shown in FIG. 10 which is indicated by reference numeral 50 refers to numbers of samples where no crystals were melted. One sample failed to reach 375° F. Four susceptor pads failed to reach 400° F. susceptor pads 10 failed to reach 425° F. Ten susceptor pads 10 failed to reach 450° F.

In summary, all ten of the tested susceptor pads 10 attained a temperature of 350° F. on some portion of the susceptor pad 10 underneath the fish 11. Between 375° F. and 425° F., some but not all of the susceptors reached the specified temperature. None of the susceptor pads 10 reached 450° F.

The preferred operating temperature of the susceptor pads 10 according to the present invention is between about 350° F. and about 425° F.

Figure 11:
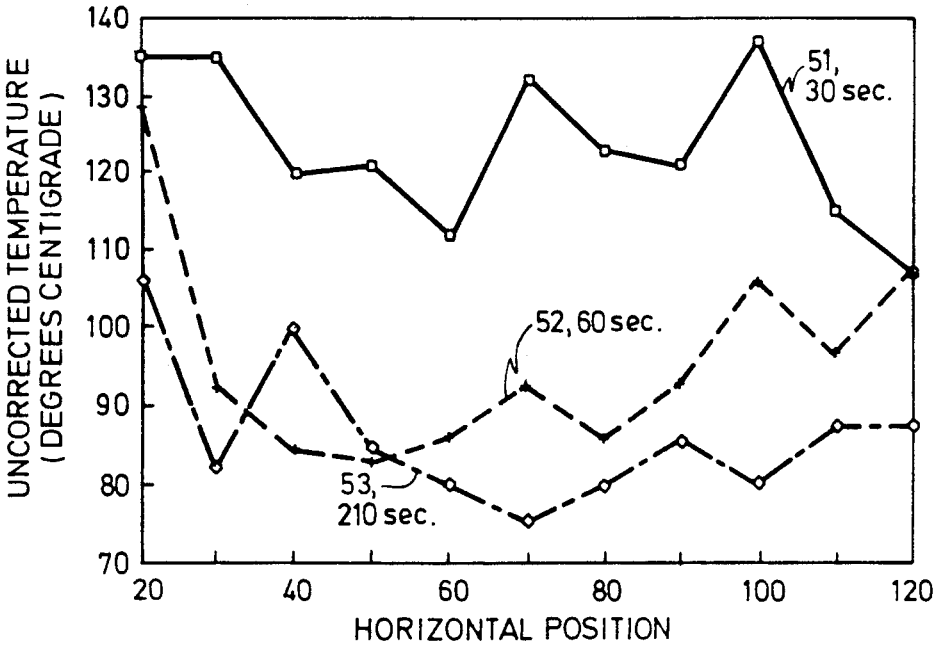
FIG. 11 is a graph illustrating the heating profile of a susceptor pad constructed in accordance with the present invention.

FIG. 11 illustrates a heating profile of a susceptor pad 10 constructed in accordance with the present invention. The temperature of various horizontal positions of a susceptor pad 10 were measured at heating times equal to 30 seconds, 60 seconds, and 210 seconds. Curve 51 represents the temperature profile of the susceptor pad 10 at a heating time equal to 30 seconds. The temperature at a heating time of 30 seconds was initially relatively high. Curve 52 represents the temperature profile at a time 60 seconds into the heating cycle. At a heating time equal to 60 seconds, the temperature of the susceptor pad 10, particularly in the center area in contact with the food substance 11, had dropped dramatically. In this particular susceptor pad 10, the temperature rose quickly and dropped quickly during the initial phase of the heating cycle. At a cooking time of 210 seconds, represented by curve 53, the temperature of the susceptor pad 10 was generally lower than the temperature at a cooking time of 60 seconds. In particular, the temperature of the edges of the susceptor pad 10 also dropped.

FIG. 12 illustrates an alternative embodiment of a 10 thermal insulation means 19'. The susceptor pad 10' has a raised perimeter support 37. The raised support 37 may also be described as a lip or rim 37. Moisture escape means 38, in this case consisting of passageways 38, are provided to allow moisture to escape to oven atmosphere 24. A metallized layer 14' is provided where a metal coating is deposited upon a suitable support layer.

Yet another alternative embodiment of the present invention is illustrated in FIG. 13. In this embodiment, the susceptor pad 10'' has passageways or slots 39 preformed or pre-cut in the metal layer 16''. This is shown more clearly in FIG. 13A. The metal layer 16'' may be supported upon a layer different from the polyester sheet 15 shown in the embodiment illustrated in FIG. 4. As shown in FIG. 13B, the metal layer 16'' may be deposited or otherwise formed on any suitable supporting layer 15''. The slots 39 are formed so that moisture can migrate through the metal layer 16'' and through a moisture permeable supporting layer 18 and escape. In the illustrated embodiment, the metallized layer 16'' and support layer 15'' are adhesively bonded to a paperboard support 18 by suitable adhesive 17''.

While an offset staggered pattern of slots 39 is illustrated in FIG. 13A, other configurations of slots 39 may give satisfactory results. For example, a substantial reduction in the number of slots 39 may give good results. Alternatively, thin slits may be cut in the metallized layer 16''. Or holes may be punched in the metallized layer 16''. FIG. 13A shows the slots 39 are oriented lengthwise in the same direction. The slots 39 or other passageways may be oriented perpendicularly to each other, and may intersect each other. In addition, the slots 39 shown in FIG. 13B can extend through the face 18, in which case the face 18 need not be moisture permeable.

In an experiment, a susceptor pad 10 and fish fillet 11 were heated for two minutes to allow cracks 22 to form in the surface of the susceptor pad 10. Heating was discontinued, and the fish fillet 11 was replaced by a new uncooked fish fillet 11. The second fish fillet 11 was then heated for the normal cooking time. The resulting cooked second fish fillet was not crisp.

The above description has been primarily directed to one or more presently preferred embodiments of the invention. The true scope of the invention is defined by the following claims, and should not necessarily be limited to the particular embodiments described above. Those skilled in the art will recognize many additions, deletions, substitutions and modifications which may be made to the particular embodiments described above, once they have the benefit of the teachings of this invention. The true scope of the invention is defined by a proper interpretation of the claims that follow.

What is claimed is:

1. A packaging system for crisping the surface of a breaded and battered food substance when exposed to microwave radiation, comprising in combination:

a breaded and battered food substance;

susceptor means responsive to microwave radiation for substantially heating when exposed to microwave radiation, the susceptor means being generally planar, the susceptor means being in contact with only one surface of the breaded and battered food substance, the susceptor means being operative to heat one surface of the breaded and battered food substance sufficiently high to crisp the surface when the susceptor means is exposed to microwave radiation, the susceptor means being positioned in a region of a microwave oven having a high field intensity, the susceptor means being moisture permeable due to a plurality of cracks formed in the susceptor means over at least part of an area corresponding to the surface area of the breaded and battered food substance in contact with the susceptor means;

means for allowing moisture that passes through the cracks formed in the susceptor to escape to atmosphere to enhance the crispness of the surface of the breaded and battered food substance that is heated; and, thermal insulation means disposed against the susceptor means remote from the breaded and battered food substance for thermally insulating the susceptor means from the floor of the microwave oven, whereby the surface of the breaded and battered food substance heated by the susceptor means is rendered crisp by microwave cooking and the breaded and battered food substance is perceived as crisp by a consumer even though only one surface of the breaded and battered food substance is heated by the susceptor means, the opposing surface of the breaded and battered food substance having a sufficiently low average moisture content that it is not perceived as mushy.

2. The packaging system according to claim 1, wherein:

the surface of the breaded and battered food substance that is in contact with the susceptor means has an average bread crumb moisture content by weight less than 12% after microwave cooking, and the opposing surface has an average bread crumb moisture content by weight that does not exceed 18% after microwave cooking.

3. The packaging system according to claim 2, wherein:

the susceptor means is positioned substantially parallel to a reflective surface of the microwave oven and is spaced therefrom a distance that is between about 0.15 and about 0.35 wavelengths.

4. The packaging system according to claim 2, wherein:

the susceptor means is positioned substantially parallel to a reflective surface of the microwave oven and is spaced therefrom a distance that is between about 0.2 and about 0.3 wavelengths.

5. The packaging system according to claim 2, wherein:

the susceptor means is positioned substantially parallel to a reflective surface of the microwave oven and is spaced therefrom a distance that is between about 0.23 and about 0.27 wavelengths.

6. The packaging system according to claim 1, wherein:

the thermal insulation means is moisture permeable.

7. The packaging system according to claim 3, wherein:

the thermal insulation means is moisture permeable.

8. The packaging system according to claim 5, wherein:

the thermal insulation means is moisture permeable.

9. The packaging system according to claim 6, wherein:

the food substance is a high moisture content food substance.

10. The packaging system according to claim 8, wherein:

the food substance is a high moisture content food substance.

11. The packaging system according to claim 10, wherein:

the food substance is fish.

12. The packaging system according to claim 3, wherein:

the center of the food substance is positioned at a distance that is between about 0.4 and about 0.6 wavelengths from the reflective surface of the microwave oven.

13. The packaging system according to claim 4, wherein:

the center of the food substance is positioned at a distance that is between about 0.45 and about 0.55 wavelengths from the reflective surface of the microwave oven.

14. The packaging system according to claim 13, wherein:

the food substance is a high moisture content food substance.

15. The packaging system according to claim 14, wherein:

the thermal insulation means is moisture permeable.

16. An apparatus for crisping the surface of a food substance when exposed to microwave radiation, comprising:

susceptor means responsive to microwave radiation for substantially heating a surface of a food substance that is to be crisped, said susceptor means being located in close proximity to said food surface to heat the food surface when the susceptor means is heated by microwave radiation in order to enhance the crispness of said food surface, said susceptor means being moisture permeable due to a plurality of cracks which form in the susceptor means over substantially an area corresponding to the food surface area that is heated at least during a portion of the time that said food surface is exposed to microwave heating; and, means for allowing moisture that diffuses through the susceptor means to escape to atmosphere, thereby enhancing the crispness of said food surface.

17. The apparatus according to claim 16, wherein:

the susceptor means comprises a film of metal.

18. The apparatus according to claim 17, wherein:

the means for allowing moisture to escape comprises a polyester layer.

19. The apparatus according to claim 18, wherein:

the means for allowing moisture to escape further comprises a rigid face adhesively affixed to the polyester layer, the face being moisture permeable.

20. The apparatus according to claim 19, further comprising:

thermal insulating means supporting the susceptor means for thermally insulating the susceptor means from a supporting surface of the microwave oven.

21. The apparatus according to claim 20, wherein:

the thermal insulating means comprises a corrugated medium supporting the rigid face, the corrugated medium having flutes which allow moisture to escape to oven atmosphere.

22. The apparatus according to claim 20, wherein:

said rigid face is paperboard.

23. The apparatus according to claim 21, wherein:

the polyester layer comprises biaxially oriented heat set polyester, the polyester layer being operable to form cracks in the susceptor means when the polyester is heated to allow moisture to diffuse through the susceptor means during microwave heating.

24. The apparatus according to claim 23, wherein:

the rigid face is paperboard.

25. The apparatus according to claim 16, wherein:

the means for allowing moisture to escape comprises a biaxially oriented heat set polyester layer, the polyester layer being operable to form cracks in the susceptor means when the polyester layer is heated, thereby allowing moisture to escape through the susceptor means during microwave heating.

26. The apparatus according to claim 25, wherein:

the susceptor means is a generally planar metallized layer deposited on the polyester layer, the metallized layer being positioned generally parallel to a reflective surface of a microwave oven cavity, the metallized layer being positioned at a distance between about 0.2 wavelengths and about 0.3 wavelengths from the reflective surface.

27. The apparatus according to claim 26, further comprising:

a breaded and battered food substance positioned in close proximity to the susceptor means, the center of the food substance being spaced from the reflective surface a distance between about 0.45 wavelengths and about 0.55 wavelengths.

28. The apparatus according to claim 16, wherein:

the susceptor means comprises a film of aluminum.

29. The apparatus according to claim 19, wherein:

the film of metal is generally planar, the film of metal is positioned generally parallel to a reflective surface of a microwave oven cavity, the film of metal being positioned at a distance between about 0.2 wavelengths and about 0.3 wavelengths from the reflective surface.

30. The apparatus according to claim 29, further comprising:

a breaded and battered food substance positioned in close proximity to the susceptor means, the center of the food substance being spaced from the reflective surface a distance between about 0.45 wavelengths and about 0.55 wavelengths.

31. Package for crisping a surface of a food substance, comprising:

conductive heating means, being responsive to microwave radiation and being located in close proximity to a surface of a food substance to be crisped, for substantially heating said food surface; and, thermal sensitive means for supporting the conductive heating means, the thermal sensitive means being responsive to heating resulting from microwave radiation to form moisture passageways to allow moisture to diffuse through the conductive heating means to atmosphere, the thermal sensitive means also being operative to decrease the responsiveness of the conductive heating means to microwave radiation by creating a plurality of conductivity breaks in the surface of the conductive heating means.

32. The package according to claim 31, wherein:

the conductive heating means comprises a thin film of metal.

33. The package according to claim 31, wherein:

the conductive heating means comprises a thin film of aluminum deposited upon a substrate.

34. The package according to claim 33, wherein:

the thermal sensitive means comprises a layer of polyester.

35. The package according to claim 33, wherein:

the thermal sensitive means comprises a layer of biaxially oriented heat set polyester.

36. The package according to claim 33, further comprising:

thermal insulating means, supporting the conductive heating means, for thermally insulating the conductive heating means from the microwave oven wall.

37. The package according to claim 35, further comprising:

thermal insulating means, supporting the conductive heating means, for thermally insulating the conductive heating means from the microwave oven wall.

38. The package according to claim 36, wherein:

the conductive heating means is positioned in a region of high field intensity within the microwave oven when the conductive heating means is irradiated by microwave radiation.

39. The package according to claim 36, wherein:

the conductive heating means is positioned approximately one fourth wavelength from a reflective surface in the microwave oven cavity.

40. The package according to claim 39, wherein:

the conductive heating means is oriented generally parallel to the reflective surface.

41. The package according to claim 31, further comprising:

thermal insulating means, supporting the conductive heating means, for thermally insulating the conductive heating means from the microwave oven wall.

42. A food packaging system providing microwave heatable breaded and battered food substances having a crisp surface after heating, comprising:

a breaded and battered food substance having a surface to be crisped;

a susceptor pad for supporting the breaded and battered food substance where the surface of the breaded and battered food substance to be crisped is disposed against the susceptor pad, the susceptor pad including:

(a) a conductive film that heats when exposed to microwave radiation;

(b) a support layer that supports the conductive film, the support layer being operative to allow moisture to pass through the conductive film and the support layer during microwave heating; and, (c) corrugated flutes in water vapor communication with the support layer to allow moisture to escape to oven atmosphere;

the food packaging system being operative to make crisp the surface of the breaded and battered food substance that is disposed against the susceptor pad, and to make an opposing surface of the breaded and battered food substance not soggy.

43. The food packaging system according to claim 42, wherein:

the conductive film is a thin film of aluminum;

the support layer includes a layer of polyester which shrinks when heated by the conductive film to create a plurality of openings in the conductive film; and, a sheet of moisture permeable paperboard is provided to support the layer of polyester, the polyester being adhesively bonded to the paperboard.

44. The food packaging system according to claim 42, wherein:

the conductive film is generally parallel to a reflective surface of a microwave oven and is positioned a distance between about 0.2 wavelengths and about 0.3 wavelengths from the reflective surface.

45. The food packaging system according to claim 43, wherein:

the thin film of aluminum is generally parallel to a reflective surface of a microwave oven and is positioned a distance between about 0.2 wavelengths and about 0.3 wavelengths from the reflective surface.

46. The food packaging system according to claim 42, wherein:

the support layer and conductive film have passageways formed therethrough to provide water vapor communication between the surface of the breaded and battered food substance and oven atmosphere, the passageways being formed prior to exposure to microwave radiation.

47. The food packaging system according to claim 46, further comprising:

a sheet of moisture permeable paperboard adhesively bonded to the conductive film.

48. The packaging system according to claim 46, wherein:

the conductive film is generally parallel to a reflective surface of a microwave oven and is positioned a distance between about 0.2 wavelengths and about 0.3 wavelengths from the reflective surface.

49. A method for crisping a surface of a food product in a microwave oven, comprising the steps of:

intensely heating a surface of a food product, which is to be made crisp, using microwave radiation to heat a thin film of conductive material that heats in response to microwave radiation;

forming openings in the film of conductive material, after an initial heating period, in order to allow moisture to escape and to reduce the responsiveness of the film of conductive material to microwave radiation; and, channelling moisture, from the surface which is to be made crisp, to oven atmosphere, by diffusing moisture through the openings in the film of conductive material and out corrugated flutes in structure supporting the film of conductive material.

50. The method according to claim 49, further comprising the step of:

crisping only one surface of the food product by heating with a film of conductive material, while the opposing surface of the food product is exposed to oven atmosphere, thereby conveniently producing a food product which is perceived as crisp by a consumer.

51. The method according to claim 49, further comprising the step of:

positioning the food product where the interior of the food product is in a region of low microwave field intensity.

52. The method according to claim 51, further comprising the step of:

positioning the food product where the center of the food product is in a region of low microwave field intensity.

53. The method according to claim 49, further comprising the step of:

positioning the film of conductive material in a region of high microwave field intensity.

54. The method according to claim 53, further comprising the step of:

positioning the food product where the center of the food product is in a region of low microwave field intensity.

55. The method according to claim 50, further comprising the step of:

positioning the film of conductive material in a region of high microwave field intensity.

56. A method for producing a food product which is perceived as crisp when eaten by a consumer, comprising the steps of:

intensely heating one surface of a food product with a thin film of conductive material which heats in response to microwave radiation, while the opposed surface of the food product is not heated by contact with a film of conductive material, the surface of the food product heated by the thin film of conductive material having an average bread crumb moisture content;

positioning the thin film of conductive material so that it is located in a region of high field intensity when exposed to microwave radiation;

thermally insulating the thin film of conductive material from supporting surfaces in a microwave oven; and, reducing the average bread crumb moisture content by weight of the surface of the food product heated by the thin film of conductive material to less than about 12%, while not allowing the average bread crumb moisture content by weight of the opposed surface to exceed 18% after heating with microwave radiation;

thereby crisping one surface of the food product sufficiently so that the food product is perceived as crisp when eaten by a consumer.

57. A method for producing a food product which is perceived as crisp when eaten by a consumer, comprising the steps of:

intensely heating one surface of a food product with a thin film of conductive material which heats in response to microwave radiation, while the opposed surface of the food product is not heated by contact with a film of conductive material, the surface of the food product heated by the thin film of conductive material having an average bread crumb moisture content;

positioning the thin film of conductive material so that it is located in a region of high field intensity when exposed to microwave radiation;

thermally insulating the thin film of conductive material from supporting surfaces in a microwave oven; and, reducing the average bread crumb moisture content by weight of the surface of the food product heated by the thin film of conductive material to less than about 11%, while not allowing the average bread crumb moisture content by weight of the opposed surface to exceed 18% after heating with microwave radiation;

thereby crisping one surface of the food product sufficiently so that the food product is perceived as crisp when eaten by a consumer.

58. A method for producing a food product which is perceived as crisp when eaten by a consumer, comprising the steps of:

intensely heating one surface of a food product with a thin film of conductive material which heats in response to microwave radiation, while the opposed surface of the food product is not heated by contact with a film of conductive material, the surface of the food product heated by the thin film of conductive material having an average bread crumb moisture content;

positioning the thin film of conductive material so that it is located in a region of high field intensity when exposed to microwave radiation;

thermally insulating the thin film of conductive material from supporting surfaces in a microwave oven; and, reducing the average bread crumb moisture content by weight of the surface of the food product heated by the thin film of conductive material to less than about 10½%, while not allowing the average bread crumb moisture content by weight of the opposed surface to exceed 18% after heating with microwave radiation;

thereby crisping only one surface of the food product sufficiently so that the food product is perceived as crisp when eaten by a consumer.

59. A method for producing a food product which is perceived as crisp when eaten by a consumer, comprising the steps of:

intensely heating one surface of a food product with a thin film of conductive material which heats in response to microwave radiation, while the opposed surface of the food product is not heated by contact with a film of conductive material, the surface of the food product heated by the thin film of conductive material having an average bread crumb moisture content;

positioning the thin film of conductive material so that it is located in a region of high field intensity when exposed to microwave radiation;

thermally insulating the thin film of conductive material from supporting surfaces in a microwave oven; and, reducing the average bread crumb moisture content by weight of the surface of the food product heated by the thin film of conductive material to less than about 10%, while not allowing the average bread crumb moisture content by weight of the opposed surface to exceed 18% after heating with microwave radiation;

thereby crisping one surface of the food product sufficiently so that the food product is perceived as crisp when eaten by a consumer.

60. A method for producing a food product which is perceived as crisp when eaten by a consumer, comprising the steps of:

intensely heating one surface of a food product with a thin film of conductive material which heats in response to microwave radiation, while the opposed surface of the food product is not heated by contact with a film of conductive material, the surface of the food product heated by the thin film of conductive material having an average bread crumb moisture content;

positioning the thin film of conductive material so that it is located in a region of high field intensity when exposed to microwave radiation;

thermally insulating the thin film of conductive material from supporting surface in a microwave oven; and, reducing the average bread crumb moisture content by weight of the surface of the food product heated by the thin film of conductive material to less than about 9%, while not allowing the average bread crumb moisture content be weight of the opposed surface to exceed 18% after heating with microwave radiation;

thereby crisping one surface of the food product sufficiently so that the food product is perceived as crisp when eaten by a consumer.

* * * * *

UNITED STATES PATENT AND TRADEMARK OFFICE

CERTIFICATE OF CORRECTION

PATENT NO. : 5,041,295

DATED : August 20, 1991

INVENTOR(S) : Michael R. Perry et al.

It is certified that error appears in the above—identified patent and that said Letters Patent is hereby corrected as shown below:

Column 9, line 42, "("λ≠)" should be -- ("λ") --.

Column 11, line 21, after "2.02 cm" add -- and --.

Column 19, line 24, before "susceptors" insert -- Six --; line 56, at the end of the line delete "10".

Column 20, line 65 (line 23 of claim 1), after "susceptor" insert -- means --.

Column 28, line 22 (line 16 of claim 60), change "surface" to -- surfaces --; line 28 (line 22 of claim 60), change "be" to -- by --.

Signed and Sealed this

Sixth Day of October, 1992

*Attest:*

DOUGLAS B. COMER

*Attesting Officer*

*Acting Commissioner of Patents and Trademarks*